United States Patent [19]

Han

[11] Patent Number: 4,793,253

[45] Date of Patent: Dec. 27, 1988

[54] MACHINE FOR PRINTING SELLER IDENTIFICATION ON LOTTERY TICKETS

[76] Inventor: Leon M. Han, 671 Aldo Ave., #21, Santa Clara, Calif. 95054

[21] Appl. No.: 930,775

[22] Filed: Nov. 14, 1986

[51] Int. Cl.[4] ..... B41F 11/00

[52] U.S. Cl. ..... 101/329; 101/213

[58] Field of Search ..... 101/329, 216, 213, 328, 101/330, 331, 327, 219

[56] References Cited

U.S. PATENT DOCUMENTS 695,416 3/1902 Ring ..... 101/213

2,887,047 5/1959 McKay ..... 101/329

3,086,461 4/1963 Gill ..... 101/213 X

*Primary Examiner*—Edgar S. Burr

*Assistant Examiner*—Moshe I. Cohen

*Attorney, Agent, or Firm*—Flehr, Hohbach, Test, Albritton & Herbert

[57] ABSTRACT

Small, inexpensive printing machine for imprinting information such as seller identification data on preprinted lottery tickets and the like. The tickets are supplied in elongated strips, and the machine has a printing wheel with peripheral character forming elements for imprinting the desired information upon each successive ticket as the strip is pulled manually through the machine.

7 Claims, 1 Drawing Sheet

MACHINE FOR PRINTING SELLER IDENTIFICATION ON LOTTERY TICKETS

This invention pertains generally to printing information on successive tickets in a strip, and more particularly to a small hand-held machine which is particularly suitable for printing seller identification information on preprinted lottery tickets.

In some areas, lottery tickets are supplied in elongated strips which can be folded or rolled for ease of handling and storage. Before the tickets are sold, each licensed seller must print or write certain identifying information such as his name and address on each of the tickets. This is commonly done manually with a rubber stamp, and it is a time consuming, monotonous operation.

It is in general an object of the invention to provide a new and improved machine for printing identifying information on lottery tickets and the like.

Another object of the invention is to provide a machine of the above character which is relatively inexpensive and easy to use.

These and other objects are achieved in accordance with the invention by providing a small printing machine having a hand-held frame with guide means defining a path along which a strip of tickets can be fed, a pivot arm mounted on the frame, a printing wheel rotatably mounted on the pivot arm for rolling engagement with the tickets as the strip is fed along the path, an ink roller mounted on the pivot arm in peripheral engagement with the printing wheel, and means for yieldably urging the printing wheel toward the tickets moving past the wheel.

Figure 1:
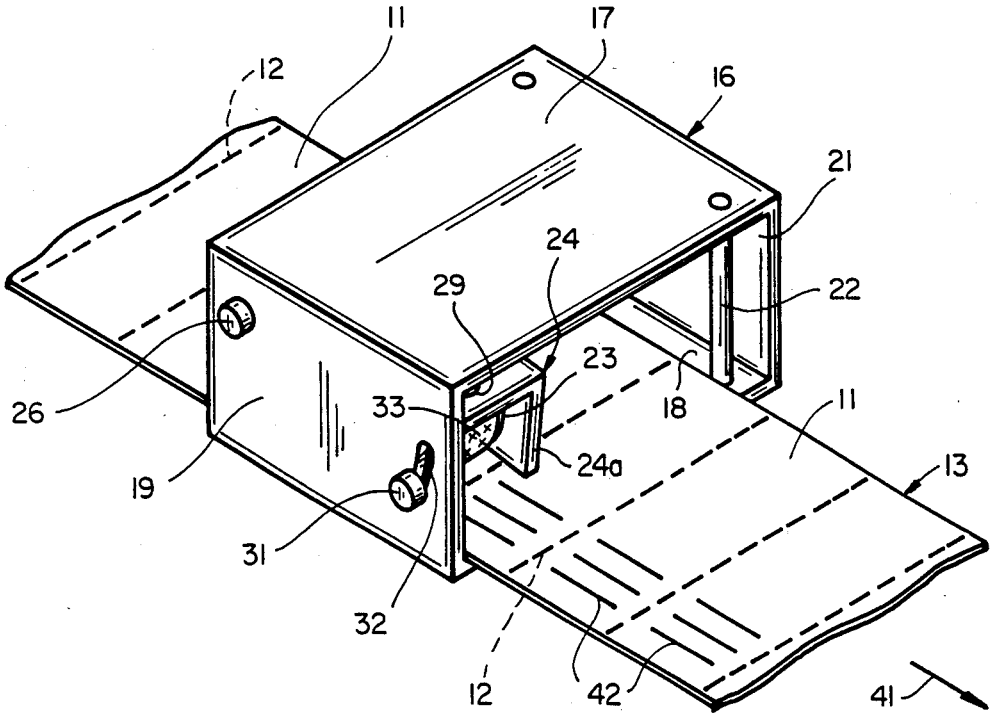
FIG. 1 is an isometric view of one embodiment of a printing machine according to the invention.
Figure 2:
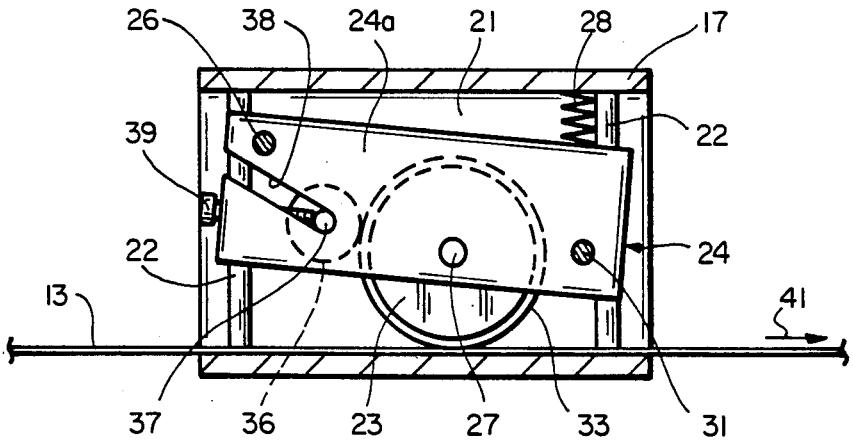
FIG. 2 is a cross-sectional view of the printing machine of FIG. 1.

In the drawings, the printing machine is illustrated in connection with a plurality of generally rectangular lottery tickets 11 which are separably joined together along opposing edges thereof by lines of perforation 12 to form an elongated strip 13.

The machine comprises a relatively small, generally rectangular frame 16 which is adapted to be held by the hand of a person using the machine. The frame has generally planar top and bottom walls 17, 18 and side walls 19, 21, and the front and rear sides of the frame are open.

A pair of guide posts 22 extend between top wall 17 and bottom wall 18 and are spaced from side wall 19 by a distance slightly greater than the width of strip 13. Posts 22, side wall 19 and bottom wall 18 define a path along which the strip of tickets can be fed.

A printing wheel 23 is rotatably mounted on an arm 24 which is pivotally mounted on side wall 19 by means of a pivot pin 26. In the embodiment illustrated, pin 26 comprises a screw which passes through a clearance hole (not shown) in side wall 19 and is threadedly received in the pivot arm. The arm has a generally U-shaped cross-section with a pair of generally parallel side flanges **24*a*, and printing wheel 23 is mounted on an axle 27 which extends between the two side flanges. The printing wheel is positioned toward the free end of the pivot arm, and a spring 28 yieldably urges the free end of the arm and the printing wheel in a downward direction toward bottom wall 18. The spring is positioned between the lower side of top wall 17 and the upper side of pivot arm 24**, with the lower portion of the spring being received in a recessed area in the upper surface of the pivot arm.

A pin 31 having an enlarged head projects laterally from pivot arm 24 and passes through an arcuate slot 32 in side wall 19 near the free end of the pivot arm. This pin can, for example, consist of a screw threadedly affixed to the side flange of the pivot arm adjacent to side wall 19. The pin and the slot serve as a guide for the free end of the pivot arm, and the enlarged head serves as a knob by which the free end of the pivot arm can be raised to disengage the printing wheel from bottom wall 18 or the tickets within the machine.

Printing wheel 23 has a peripheral printing mat or die 33 with a plurality of character forming elements for printing the desired information on the tickets. The circumference of the printing wheel and the circumferential extent of the character forming elements on the printing mat are selected to correspond to the width of the tickets, i.e. the distance between perforation lines 12, so that all of the desired information will be printed on each successive ticket as it passes beneath the printing wheel. In one presently preferred embodiment, the circumference of the printing wheel is four times the width of a ticket, and four groups of the character forming elements are spaced equally about the wheel.

An inking roller 36 is mounted on pivot arm 24 in peripheral engagement with printing wheel 23 for applying ink to the character forming elements on the printing wheel. This roller is fabricated of an ink retentive material, and it has an axle 37 which is received in slots 38 in the side flanges **24*a* of the pivot arms. Slots 38 are parallel to each other and inclined obliquely t the axis of the pivot arm. Screws 39 are threadedly mounted in side flanges 24*a* and intersect slots 38 toward the inner ends of the slots. These screws abut against the side of axle 37** and press the inking roller against the printing wheel.

Operation and use of the machine for printing identifying information along the lower edges of the back sides of lottery tickets is as follows. Ink is applied to roller 36 in a conventional manner, and the printing wheel is raised by means of pin 31 to permit the tickets to be inserted into the machine. The tickets are inserted face down, with the lower edges of the tickets abutting against the inner surface of side wall 19. When the tickets are in the proper position, the free end of the pivot arm is released, and the strip of tickets is pulled through the machine in the direction indicated by arrow 41. As the tickets pass through the machine and engage printing wheel 23, they cause this wheel to rotate and print the information 42 on each successive ticket. The machine can be held in one hand while the strip of tickets is being pulled with the other. Alternatively, the machine can be placed on a supporting surface such as a table and held by hand or by other suitable means as the tickets are pulled through it.

The machine has a number of important features and advantages. It is small, inexpensive, and easy to use. In addition, it is substantially faster than the manual technique of the prior art. With the invention, for example, the seller's identifying information can be printed on a strip of 500 lottery tickets in just a few minutes, whereas it would take several hours to print the same information on these tickets with a rubber stamp.

It is apparent from the foregoing that a new and improved machine has been provided for printing identifying information on lottery tickets. While only one presently preferred embodiment has been described in detail, as will be apparent to those familiar with the art, certain changes and modifications can be made without departing from the scope of the invention as defined by the following claims.

I claim:

1. In a machine for imprinting information on successive ones of a plurality of generally rectangular tickets separably joined together along opposing edges thereof to form a strip: a frame having guide means spaced apart by a distance corresponding to the width of the strip, a pivot arm pivotally mounted on the frame and having a pair of generally parallel flanges in which obliquely extending slots are formed, a printing wheel with peripheral means for printing the information rotatably mounted on the pivot arm for rolling engagement with the tickets as the strip passes between the guide means, said printing wheel having a peripheral dimension corresponding to the distance between the opposing edges of the tickets so that the information is imprinted upon each successive ticket as it moves past the printing wheel, an inking roller mounted between the flanges on an axle which is received in the obliquely extending slots, having screws threadedly mounted in the flanges abutting against the axle to hold the inking roller against the printing wheel, and means for yieldably urging the printing wheel toward the tickets as they move past the wheel.

2. The machine of claim 1 wherein the frame is generally rectangular and adapted to be held by the hand of a person using the machine.

3. The machine of claim 1 wherein the guide means comprises a side wall of the frame and a post spaced from the side wall.

4. The machine of claim 1 wherein the printing wheel is free to be rotated by the strip of tickets as the strip is fed through the machine.

5. The machine of claim 1 wherein the means for yieldably urging the printing wheel toward the tickets comprises a spring which engages the pivot arm and the frame.

6. In a machine for imprinting information on successive ones of a plurality of generally rectangular tickets separably joined together along opposing edges thereof to form a strip: a generally rectangular hand-held frame having a top wall, a bottom wall and a side wall, a pair of posts extending between the top and bottom walls of the frame and defining a path near the bottom wall along which the strip of tickets can be fed, a pivot arm pivotally mounted on the side wall and having a pair of generally parallel flanges in which obliquely extending slots are formed, resilient means for yieldably urging one end of the pivot arm toward the bottom wall, a printing wheel having peripheral means for printing the information rotatably mounted on the pivot arm toward the one end for rolling engagement with the strip of tickets, movement of the strip causing the wheel to rotate and imprint the information on each successive ticket moving past the wheel, and an inking roller rotatably mounted between the flanges of the pivot arm on an axle received in the obliquely extending slots, and screws threadedly mounted in the flanges abutting against the axle to hold the inking roller in peripheral engagement with the printing wheel for applying ink to the printing wheel.

7. The machine of claim 6 wherein the resilient means comprises a compression spring positioned between the pivot arm and the top wall of the frame.

* * * * *